United States Patent [19]

Jeffery et al.

[11] 4,356,693

[45] Nov. 2, 1982

[54] GAS TURBINE ENGINE COMBUSTION CHAMBERS

[75] Inventors: Graham J. Jeffery, Kenilworth; Richard C. Adkins, Milton Keynes, both of England

[73] Assignee: Rolls-Royce Limited, London, England

[21] Appl. No.: 163,482

[22] Filed: Jun. 27, 1980

[30] Foreign Application Priority Data

Apr. 22, 1980 [GB] United Kingdom ..... 8013268

[51] Int. Cl.[3] ..... F02C 3/14

[52] U.S. Cl. ..... 60/39.37; 60/751

[58] Field of Search ..... 60/39.36, 39.37, 39.38, 60/751, 752; 415/207

[56] References Cited

U.S. PATENT DOCUMENTS 2,711,072 6/1955 Wetzler ..... 60/39.37

3,589,127 6/1971 Kenworthy et al. ..... 60/39.37

FOREIGN PATENT DOCUMENTS 1096624 12/1967 United Kingdom .

*Primary Examiner*—Louis J. Casaregola

*Attorney, Agent, or Firm*—Cushman, Darby & Cushman

[57] ABSTRACT

In a gas turbine engine having a can annular combustion system, the diffusion passage between the outlet annulus of the engine compressor and the inlets to the individual combustion chambers located in an annular housing, is partially defined by diffusion control housings, one of each of which is integral with the upstream end of a respective one of the combustion chambers. Each diffusion control housing is wedge-like in planform and increases in circumferential width and radial height in the downstream direction. An opening is provided to receive a fuel injector and an air outlet or inlets is located at the upstream end of each housing. The air inlet can be in the form of a single opening at the apex of the housing or in the form of an opening in each flank of the housing.

4 Claims, 12 Drawing Figures

GAS TURBINE ENGINE COMBUSTION CHAMBERS

Figure 1:
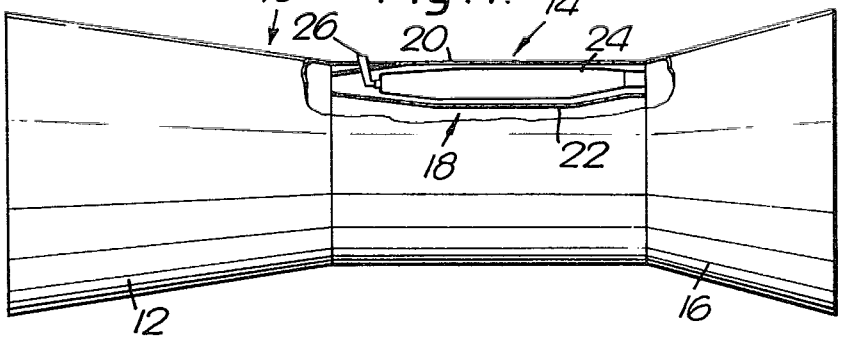

This invention relates to combustion systems of the can-annular type, for gas turbine engines and comprises a development of the combustion system described and claimed in co-pending United States patent application Ser. No. 163,481, filed June 27, 1980, and commonly assigned to Rolls-Royce Limited. In that application, some of the theoretical advantages of, and some of the practical problems associated with can-annular combustion systems were discussed. The solution to at least some of the difficulties proposed in that application was to control the rate of diffusion in the pre-combustor diffuser by the provision of radial struts of a wedge shape with the wedge apex facing upstream, the wedges being aligned with respective ones of the flame tubes of the combustion system. It was also proposed that the wedges could act as structural members and replace existing radial struts and that air scoops could be attached to the flame tubes to direct air to the combustion and dilution zones of the flame tubes.

To accommodate these proposals in an existing combustion system would necessitate a major re-design. The present invention seeks to modify the basic proposals contained in the co-pending application and to apply these modified proposals to an existing combustion system, so that a minimum of re-design is required. In particular it is proposed that each flame tube is associated with a wedge, the wedge having an air inlet to feed air to the upstream end of the flame tube.

Accordingly the present invention provides a gas turbine engine combustion system comprising a plurality of equi-spaced flame tubes located in an annular housing defined by inner and outer walls, the annular housing having an upstream diffuser casing providing a transition between an inlet arranged to receive compressed air and an outlet of larger cross-sectional area than the inlet, each flame tube, at its upstream end, having a diffusion control housing, the diffusion control housing having an inlet arranged to receive compressed air and an outlet arranged to deliver compressed air to the upstream end of the flame tube, each diffusion control housing extending between the inner and outer walls and increasing in cross-sectional area in the downstream direction, the diffuser control housings between them controlling the overall area ratio of the diffuser casing.

Each housing in cross-section may be in the shape of a sector of an annulus, e.g. having inner and outer annular walls joined by or integral with two radially extending side walls.

The inlet to the housing may be at its upstream end and may continue internally of the housing as a duct increasing in cross-sectional area in the downstream direction. Alternatively, the inlet to the housing may comprise openings in each of the side walls which may continue internally of the housing as further internal ducts.

The air flowing through each housing may be arranged to flow through swirler vanes into the upstream end of the respective flame tube and some of the said air may also be used for cooling purposes.

In plan, each diffuser control housing may appear as a wedge-like or truncated wedge-like shape with its apex or truncated apex facing upstream and its base facing downstream.

Each diffusion control housing may be attached to or be integral with its respective flame tube.

Figure 2:
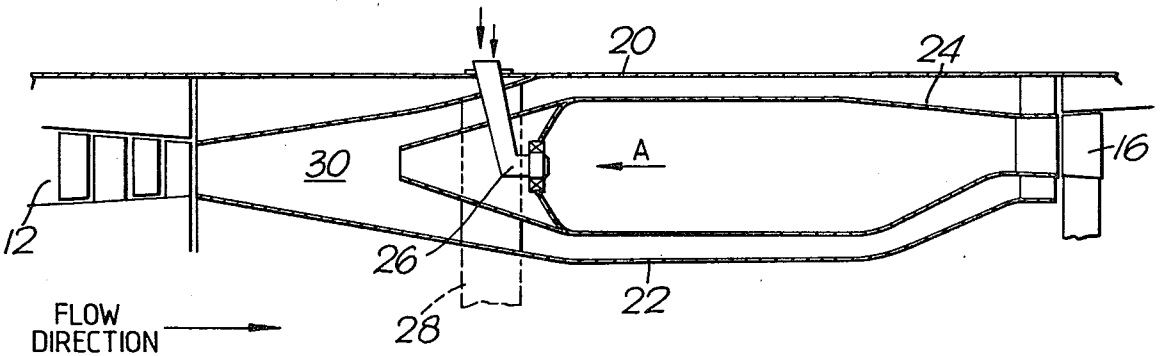
Figure 3:
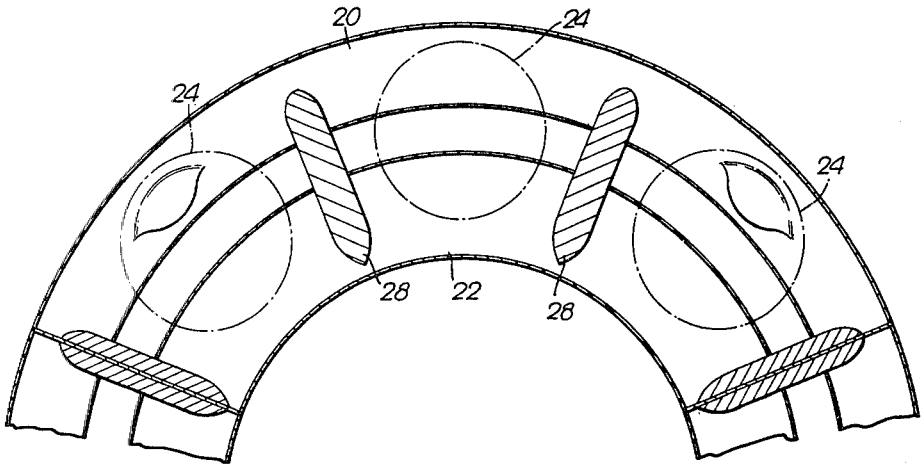
Figure 4:
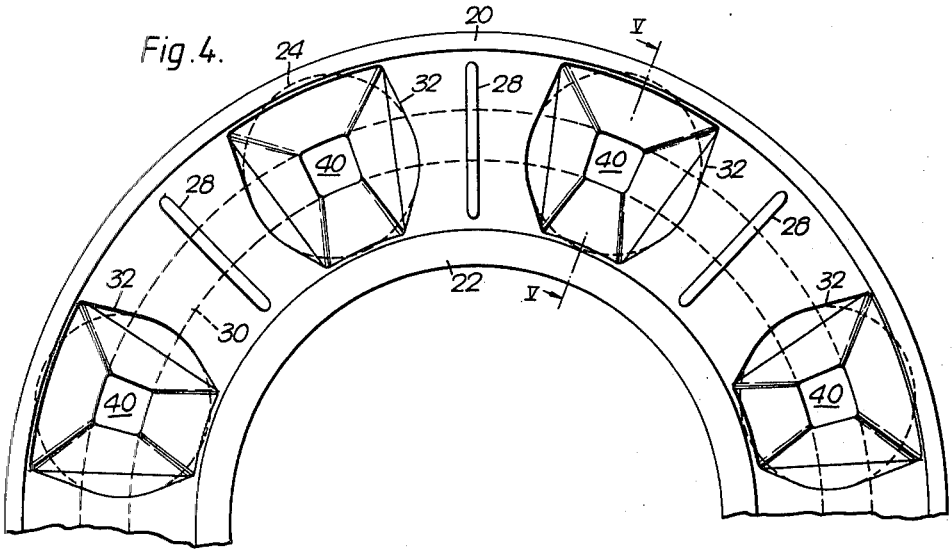
Figure 5:
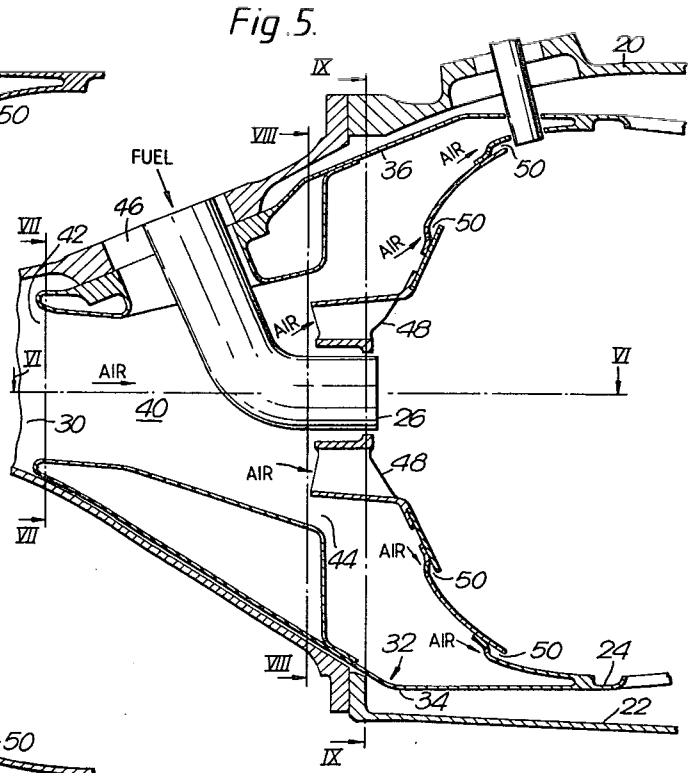
Figure 6:
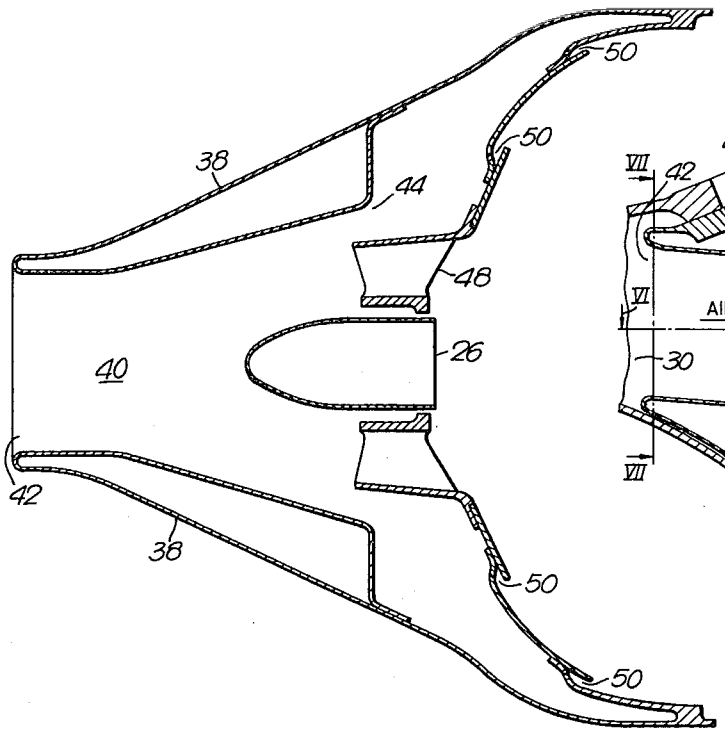
Figure 8:
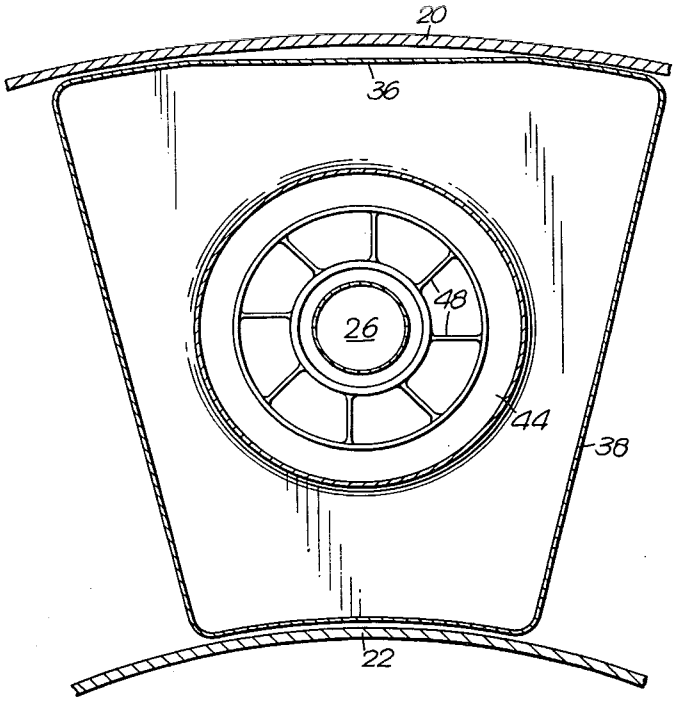
Figure 7:
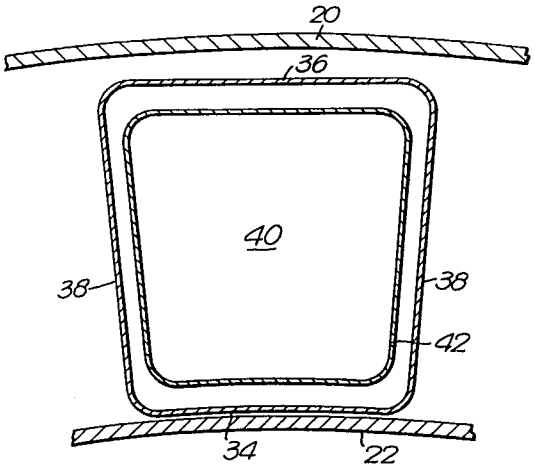
Figure 12:
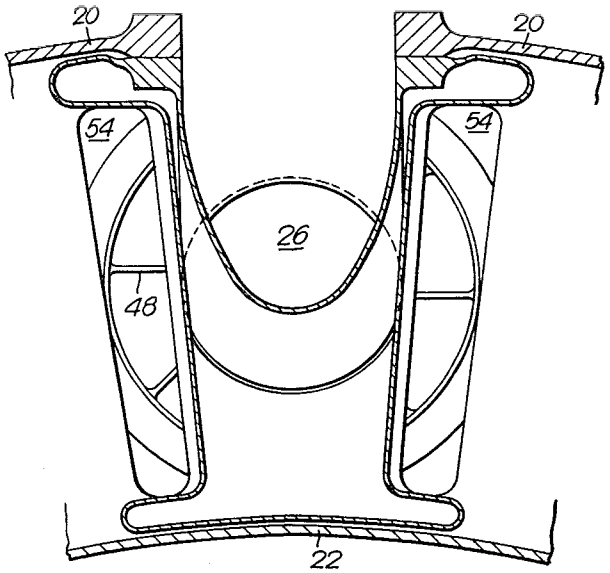
Figure 9:
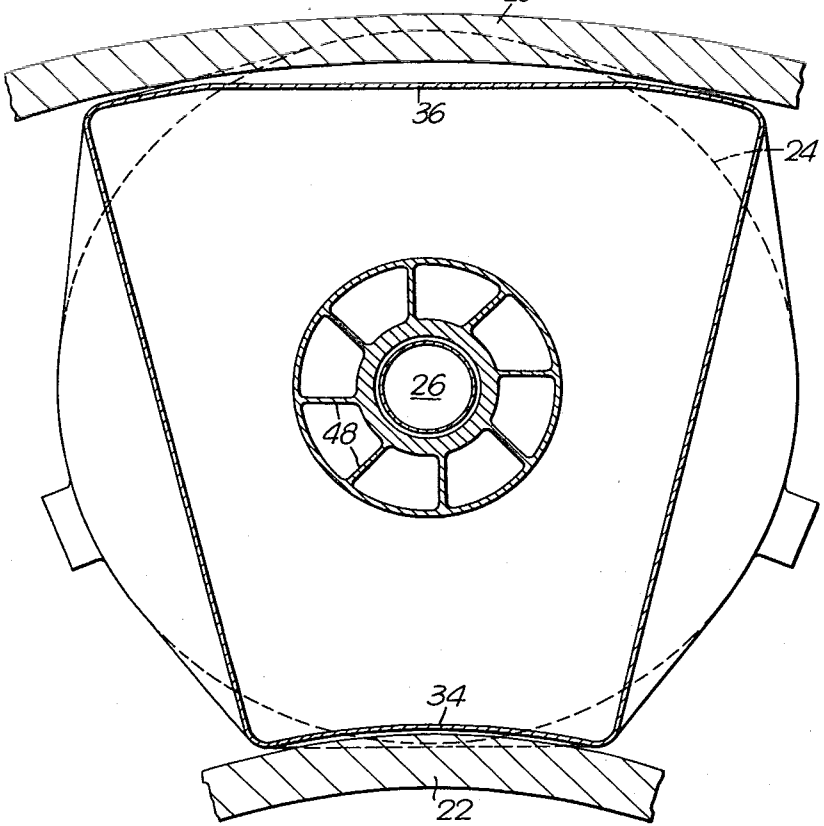
Figure 10:
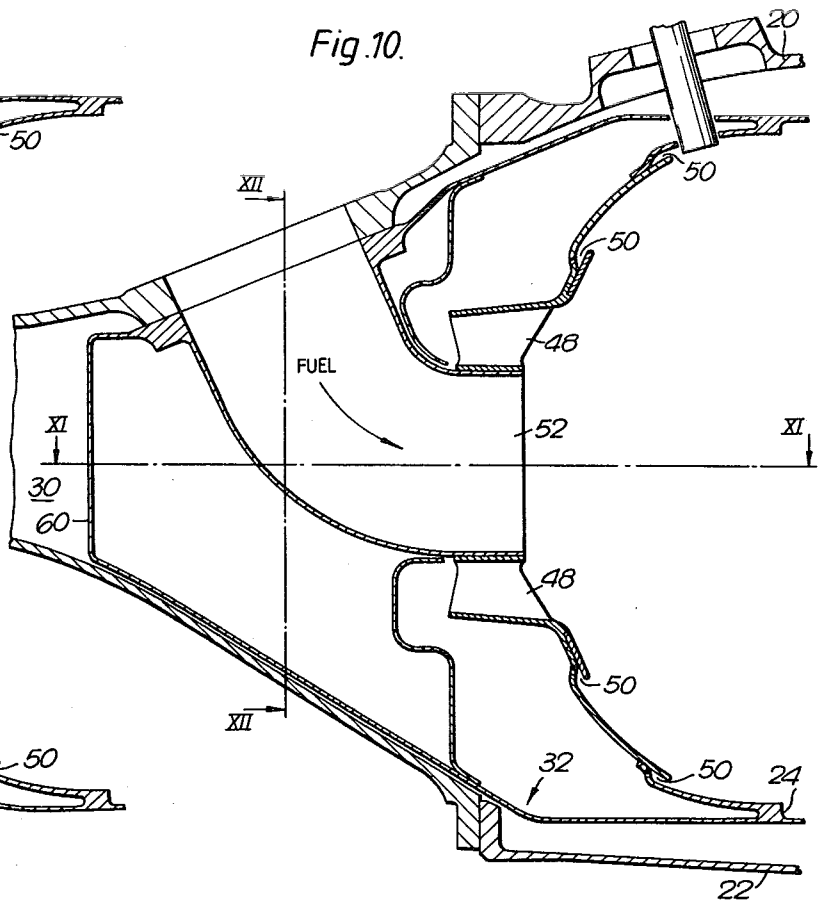
Figure 11:
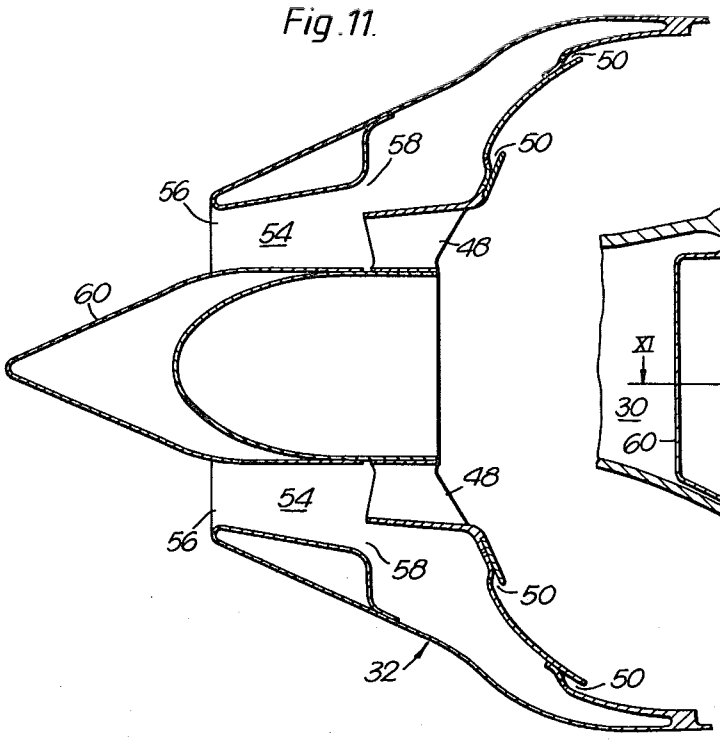

The present invention will now be more particularly described with reference to the accompanying drawings in which, FIG. 1 is a diagrammatic representation of a gas turbine engine having a can-annular combustion system, FIG. 2 is a representation of the combustion system of FIG. 1 to a larger scale, FIG. 3 is a part view on arrow 'A' in FIG. 2, FIG. 4 is a view similar to FIG. 3 but showing one form of can-annular combustion system according to the present invention, viewed in the downstream direction, FIG. 5 is a part section on line V—V in FIG. 4, FIG. 6 is a section on line VI—VI in FIG. 5, FIG. 7 is a section on line VII—VII in FIG. 5, FIG. 8 is a section on line VIII—VIII in FIG. 5, FIG. 9 is a section on line IX—IX in FIG. 5, FIG. 10 is a part view of a further form of can-annular combustion system according to the present invention, FIG. 11 is a section on line XI—XI in FIG. 10 and, FIG. 12 is a section on line XII—XII in FIG. 10.

Referring to FIGS. 1 to 3 inclusive a gas turbine engine 10 has a compressor 12 supplying compressed air to a known form of can-annular combustion system 14, the hot exhaust gases from which drive a turbine 16 which in turn drives the compressor 12.

The combustion system 14, comprises an annular housing 18 having inner and outer walls 20, 22 and a plurality of circumferentially arranged equi-spaced flame tubes 24. A load carrying strut 28 located between adjacent flame tubes extends between the walls 20 and 22 and may extend to an inner structural part of the engine. The upstream ends of the walls 20, 22 define a diffusion passage for the combustion system supply air from the compressor 12.

Referring now to FIGS. 4 to 9 inclusive, attached to the upstream end of each flame tube 24 is a diffuser control housing 32 analogous to the wedge 32 in the aforementioned patent application Ser. No. 163,481, which extends between the walls 20, 22 and which is in cross-section substantially the shape of a sector of an annulus (see FIG. 7). Each housing 32 has an external wall comprising inner and outer annular walls 34, 36 joined to or integral with two radially extending walls 38. Each housing also has internal walls defining a duct 40 having an inlet 42 for compressed air from the compressor 12 and an outlet 44 to discharge the compressed air to the upstream end of the respective flame tube 24.

The wall 20 and the housing 32 have an opening 46 for the fuel injector 26, the end of which is located in an opening in a ring of swirl vanes 48. The swirl vanes are secured in central opening in the upstream end of the flame tube, which also has apertures 50 for the through-flow of cooling air.

The external shape of each housing 32 is such that while the diffusion passage 30 is increasing in radial height, it is also decreasing in circumferential width, because each housing increases in cross-sectional area in the downstream direction and the radial height between the walls 20, 22 increases in the downstream direction. Thus in FIG. 4, the diffusion passage increases in height from dimension B to dimension C and decreases in circumferential width from dimension D to dimension E.

The internal duct 40 of each housing 32 is designed to be a continuation of the diffusion passage 30 and both the external shape of the housing and the shape of the duct 40 are designed to the aerodynamic requirements of the diffusion passage 30 and the duct 40 causing them to have a lower area ratio than would otherwise be the case, without incurring unacceptable pressure losses.

Referring now to FIGS. 10, 11 and 12, which shows a modified form of diffuser control housing 32 particularly adapted to accept a gas burner 52 (nozzle not shown) for burning low calorific value gas fuel. When burning such a fuel larger quantities of air are required and each housing 32 is provided with two diffusion ducts 54 having inlets 56 and outlets 58 arranged to receive compressor delivery air from the diffusion passage 30 and to discharge the compressor to the swirl vanes 48 and the upstream end of the flame tube 24 respectively. As will be seen more clearly in FIGS. 11 and 12, the ducts 54 are formed on the side walls of the housing 32 and leave a central upstream facing apex 60, similar to the upstream ends of the wedges 32 in the copending application Ser. No. 163,481.

I claim:

1. A gas turbine engine combustion system comprising:

an annular housing defined by inner and outer walls;

a plurality of combustion chambers equi-spaced apart and circumferentially arranged within said annular housing, each of said combustion chambers having an upstream end and a downstream end;

a diffusion passage upstream of the upstream ends of said combustion chambers, said diffusion passage being defined by upstream inner and outer portions respectively of the inner and outer walls of said annular housing and being arranged to receive a flow of compressed air; and a plurality of diffusion control housings partially defining said diffusion passage, each of said diffusion control housings being axially aligned with and extending from the upstream end of a respective one of said combustion chambers, each of said diffusion control housings being wedge-like in plan form and having a circumferential width and a radial height increasing in a downstream direction, and each of said diffusion control housings comprising radial side walls and circumferential end walls and having an upstream air inlet for receiving at least a portion of the compressed air from said diffusion passage and discharging the same into the respective one of said axially aligned combustion chambers, each of said diffusion control housings further having an opening arranged to receive a fuel injector.

2. A combustion system as claimed in claim 1 in which the air inlet to each diffusion control housing is located at its upstream end.

3. A combustion system as claimed in claim 1 in which the air inlet to each diffusion control housing comprises openings in each of the side walls of the diffusion control housing.

4. A combustion system as claimed in claim 1, in which each diffusion control housing extends between the upstream inner and outer portions of the inner and outer walls which define the diffusion passage and in cross-section is in the form of a sector of an annulus.

* * * * *